US006984142B2

(12) United States Patent
Shimizu

(10) Patent No.: US 6,984,142 B2
(45) Date of Patent: Jan. 10, 2006

(54) SOCKET FOR ELECTRICAL PARTS

(75) Inventor: Takeshi Shimizu, Kawaguchi (JP)

(73) Assignee: Enplas Corporation, Saitama (JP)

( * ) Notice: Subject to any disclaimer, the term of this patent is extended or adjusted under 35 U.S.C. 154(b) by 18 days.

(21) Appl. No.: 10/742,946

(22) Filed: Dec. 23, 2003

(65) Prior Publication Data

US 2004/0137774 A1 Jul. 15, 2004

(30) Foreign Application Priority Data

Dec. 27, 2002 (JP) ..... 2002-380805

(51) Int. Cl.
*H01R 11/22* (2006.01)

(52) U.S. Cl. ..... 439/268; 439/331

(58) Field of Classification Search ..... 439/268, 439/266, 259, 263, 264, 330, 331, 68, 71, 439/73, 206; 324/754, 755
See application file for complete search history.

(56) References Cited

U.S. PATENT DOCUMENTS 6,027,355 A * 2/2000 Ikeya ..... 439/268
6,106,319 A * 8/2000 Fukunaga et al. ..... 439/342
6,149,449 A * 11/2000 Abe ..... 439/268
6,296,504 B1 * 10/2001 Ohashi ..... 439/266
6,402,537 B2 * 6/2002 Ikeya ..... 439/259
6,796,823 B1 * 9/2004 Nakano et al. ..... 439/268

FOREIGN PATENT DOCUMENTS

JP 11-026126 1/1999

* cited by examiner

*Primary Examiner*—Alexander Gilman
(74) *Attorney, Agent, or Firm*—Staas & Halsey LLP

(57) ABSTRACT

A socket for an electrical part comprises a socket body to which an electrical part is mounted, a slide plate provided for the socket body to be movable so as to deform the contact portions of a contact pin provided for the socket body, and a driving mechanism provided for the socket body to move the slide plate. The driving mechanism includes a pair of lever members each having a force applying portion through which a force is applied to the slide plate and the force applying portion is disposed at substantially a central portion on a side portion of the slide plate in the slide plate moving direction.

18 Claims, 18 Drawing Sheets

SOCKET FOR ELECTRICAL PARTS

BACKGROUND OF THE INVENTION

1. Field of the Invention

The present invention relates to a socket for an electrical part for testing or inspecting a performance of an electrical part such as semiconductor device, which will be called hereinlater "IC package".

2. Related Art

There is known an IC socket, as such a socket for electrical part, for accommodating an IC package as an electrical part, for example, as disclosed in the Japanese Laid-open Patent Publication No. JP H11-26126-A.

In this known example, the IC package is provided with a number of solder balls, as terminals, projecting downward from the lower surface of the IC package so as to provide a grid (lattice) arrangement having vertical and horizontal rows or lines.

On the other hand, the IC socket comprises a socket body to which the IC package is mounted and accommodated, a number of contact pins arranged to the socket body to be contacted to the terminal of the IC package, a movable member movably provided for the socket body to elastically deform the contacts pins so as to be contacted to or separated from the terminals of the IC package, and a cover for moving the movable member by means of lever member.

In an operation, when the cover is moved downward, a force applied portion of the lever member is depressed and is rotated about a shaft penetrating the movable member, so that the socket body is pressed downward by a force support (fulcrum) portion on the lower end side of the lever member. Therefore, the shaft acts as force applying (functioning) portion and moves parallelly horizontally in one direction to thereby move the movable member.

According to the movement of the movable member, the contact pins are pressed and elastically deformed to thereby open a pair of contact portions of each contact pin and then to insert the solder ball of the IC package into a gap between the opened contact a portions.

On the contrary, when the cover is moved upward, the pressing force of the movable member applied on the contact pins is released, and the contact portions of each of the contact pins return toward their initial closed positions to thereby clamp the solder ball therebetween and establish an electrical connection therebetween.

In the conventional structure mentioned above, however, the shaft (as force applying portion) of the lever member is provided so as to penetrate one end side of the movable member, i.e., the rear end side portion in the moving direction at the opening of the contact portions of the contact pin, so that when the pressing force is applied to the movable member through this shaft, the force applying direction of this pressing force is not necessarily horizontal with respect to the movable member. Accordingly, in the case where such pressing force is applied to the end portion of the movable member, the other end portion thereof maybe lifted, i.e., floated, which may lead to a trouble of an unstable attitude of the movable member, thus being inconvenient.

SUMMARY OF THE INVENTION

An object of the present invention is therefore to substantially eliminate defects or inconveniences encountered in the prior art mentioned above and to provide a socket for an electrical part capable of providing structure in which the movable member of the socket body can maintain its stable attitude at the time of being pressed and moved to elastically deform the contact pins arranged to the socket body.

This and other objects can be achieved according to the present invention by providing a socket for an electrical part comprising: a socket body to which an electrical part is mounted and accommodated; a number of contact pins provided for the socket body so as to be contacted to or separated from the terminals of the electrical part, each of the contact pins being provided with a pair of contact portions between which the terminal is inserted; a movable member provided for the socket body to be movable so as to deform the contact portions of the contact pin; and a driving mechanism provided for the socket body to move the movable member, wherein the driving mechanism has a force applying portion through which a force is applied to the movable member to move it and the force applying portion is disposed at substantially a central portion on a side portion of the movable member along the movable member moving direction.

In a preferred embodiment or example in the above aspect, the movable member may be composed of a plate member having substantially a square shape to be moved in one diagonal direction thereof with respect to the socket body, and the force applying portion of the driving mechanism is disposed to a portion near a corner portion of the movable member along another diagonal line normal to the moving direction of the movable member.

The movable member may be provided, at a rear end side in a moving direction thereof, with a deformation prevention member for preventing the movable member from being deformed at a time of elastically deforming the contact pin.

The force applying portion of the driving mechanism is coupled to the deformation prevention member. The driving mechanism is provided with lever members, each of the lever members being pivotal in a vertical direction with respect to the movable member and being formed with a force applied portion to which an external force is applied, a force support portion coupled to the socket body and the force applying portion coupled to the movable member, and when the force applied portion of the lever member is pressed, the lever member is rotated around the force support portion and the movable member is thereby moved by the force applying portion.

The driving mechanism includes a further lever member provided for the movable member at a corner portion thereof along the one diagonal line in the movable member moving direction, and this further lever member is provided with a force applied portion and a support portion operatively connected to the movable member.

In a more specified aspect of the present invention, the above-mentioned object of the present invention may be achieved by providing a socket for an electrical part, which comprises: a socket body to which an electrical part is mounted and accommodated; a number of contact pins provided for the socket body so as to be contacted to or separated from the terminals of the electrical part, each of the contact pins being provided with a pair of contact portions; a slide plate provided for the socket body to be movable to thereby deform the contact portions of the contact pin, the slide plate having substantially square plate shape; a driving mechanism provided for the socket body so as to move the slide plate, the driving mechanism including an operation member mounted to the socket body to be vertically movable; and a deformation prevention member for preventing deformation of the slide plate at a time when the contact pin is elastically deformed, wherein the driving mechanism includes a pair of lever members disposed to the portions near the corner portions of the slide plate along a diagonal line normal to the moving direction of the slide plate and connected to the operation member to be applied with a pressed force when the operation member is pressed downward, and the deformation prevention member has both ends to each of which a pair of support pieces are formed between which each of the lever members are clamped and supported.

According to the present invention of the structures and characters mentioned above, since the force applying portion of the driving mechanism for moving the movable member is disposed at substantially the central portion of the movable member in the moving direction, external force is applied to the movable member at this central portion, not on the end portions thereof as in the conventional structure, the movable member can be moved with the stable attitude thereof being maintained.

In the structure of the movable member having substantially a square plate shape, the force applying portions are disposed at portions near the corner portions on the diagonal line normal to the moving direction of the movable member, so that the stable moving of the movable member by the driving mechanism can be ensured.

The arrangement of the deformation prevention member can positively prevent the movable member from being adversely deformed. Moreover, since the force applying portion of the driving mechanism is coupled to the deformation prevention member, through which the movable member is moved, the force is applied in a dispersed fashion and not concentrated, thus also ensuring the stable attitude of the movable member during its moving operation.

Furthermore, the lever member as the driving mechanism is provided with the force applied portion to which an external force is applied, the force support portion connected to the socket body as fulcrum portion and the force applying portion connected to the movable member, which is then moved when the force applied portion is pressed, the movable member is moved through the force support portion and the force applying portion of the lever member. Thus, the movable member can be stably moved with simple and compact structure.

The nature and further characteristic features of the present invention will be made more clear from the following descriptions made with reference to the accompanying drawings.

DESCRIPTION OF THE PREFERRED EMBODIMENTS

Figure 1:
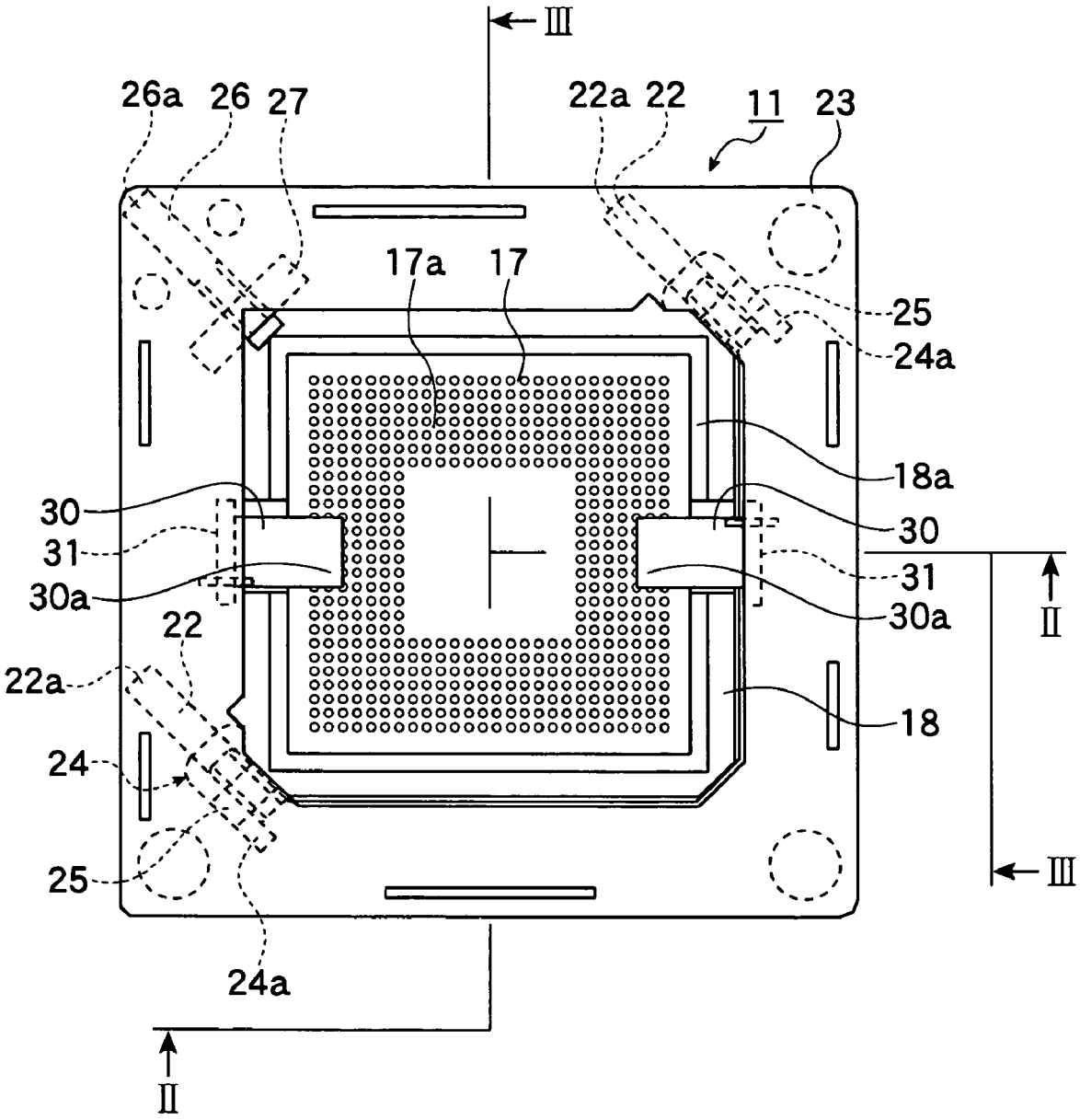
FIG. 1 is a plan view of an IC socket according to a first embodiment of the present invention.

The preferred embodiments of the present invention will be described hereunder with reference to the accompanying drawings. Further, it is to be noted that terms of "upper (upward)", "lower (downward)", "left", "right" and like terms are used herein with reference to the illustrations of the accompanying drawings or in a state that a socket body is placed horizontally.

[First Embodiment]

The first embodiment of the present invention is first described hereunder with reference to FIG. 1 to FIG. 24.

Reference numeral 11 denotes an IC socket as a socket for an electrical part, and the IC socket 11 is a socket to be arranged on a printed circuit board, not shown. An IC package 12 as an electrical part is supported or mounted to the IC socket 11 to thereby establish an electrical connection between the IC package 12 and the printed circuit board.

Figure 24A:
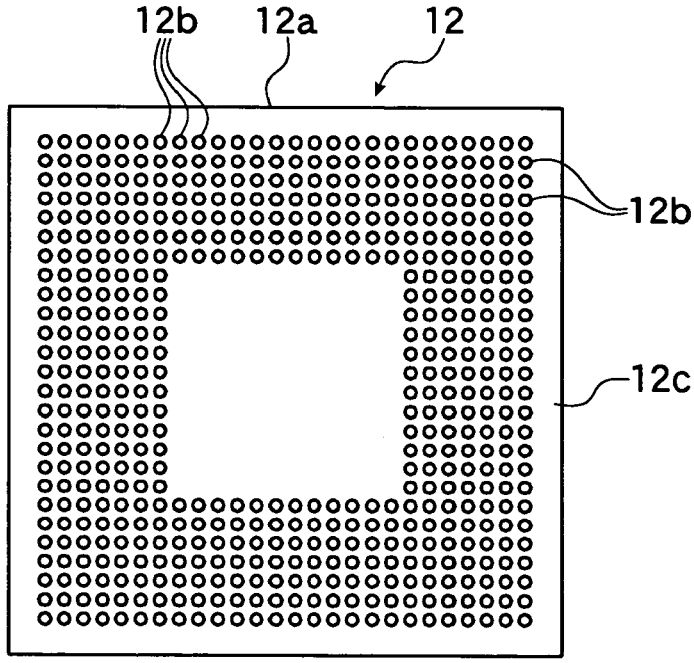
FIG. 24 represents an IC package for the IC socket of the first embodiment and includes FIG. 24A showing a front view thereof and FIG. 24B showing a bottom view thereof.
Figure 24B:
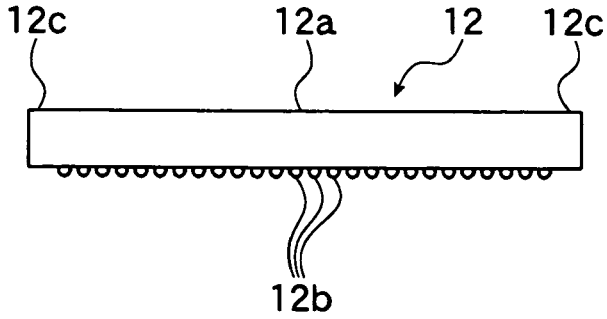
Figure 25:
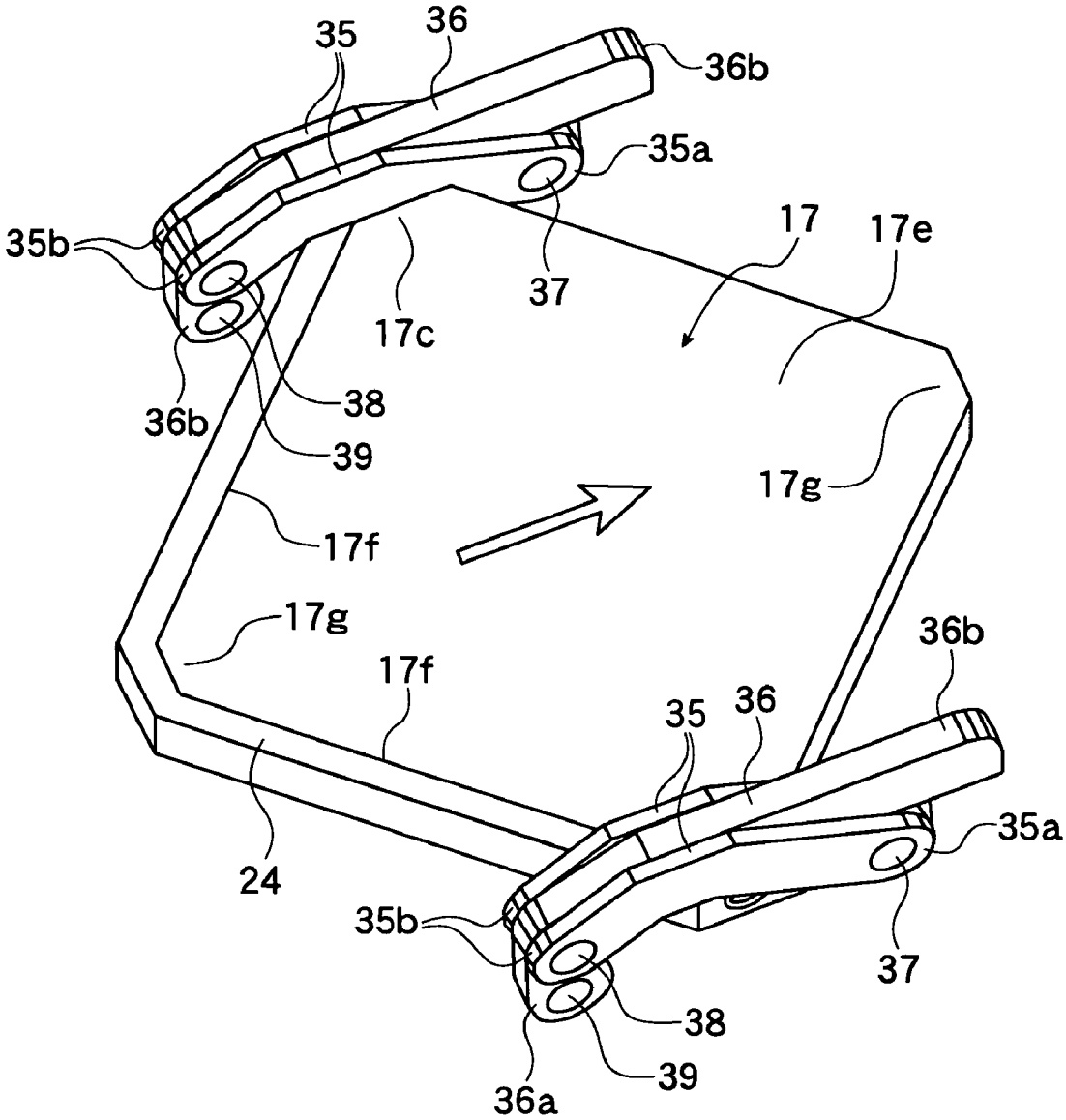
FIG. 25 is a perspective view of an IC socket according to a second embodiment of the present invention showing a slide plate, a first link, a second link, a support plate and so on of the IC socket.

The IC package 12 has a structure of so-called BGA (Ball Grid Array) type such as shown in FIGS. 24A and 24B, which, for example, includes a square-shaped package body 12*a* having a lower surface from which a number of spherical solder balls 12*b* as terminals project in a matrix arrangement.

Figure 2:
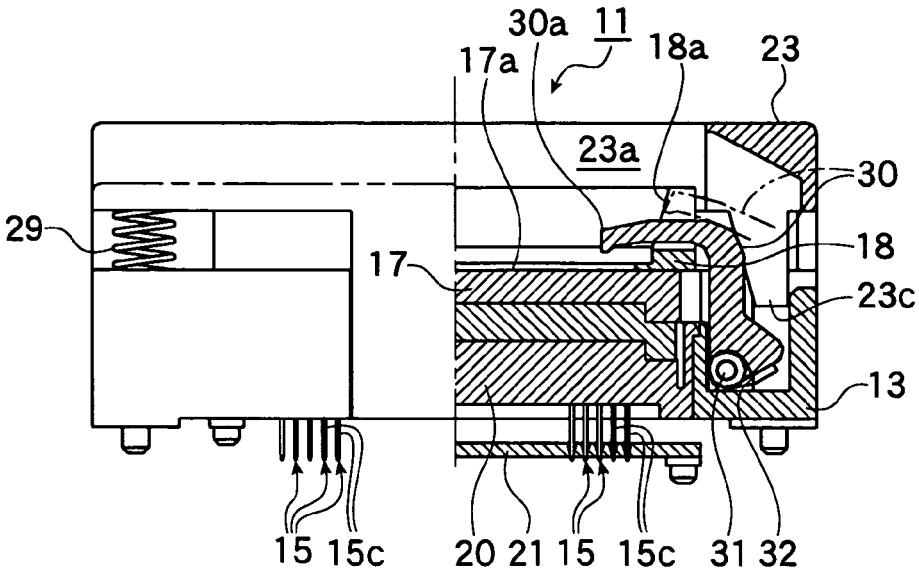
FIG. 2 is a sectional view taken along the line II—II in FIG. 1.
Figure 6:
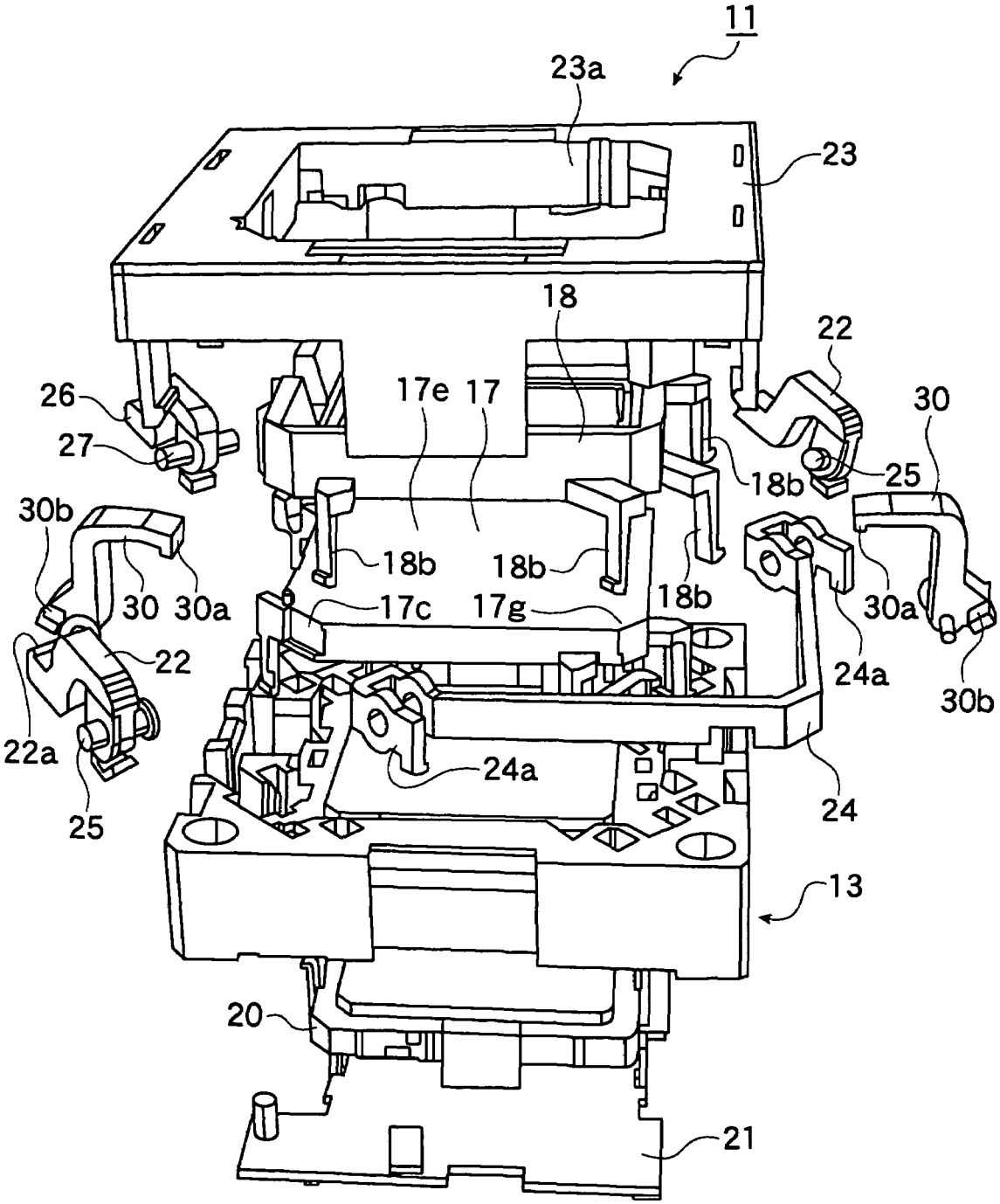
FIG. 6 is a developed perspective view of the IC socket of the first embodiment.

On the other hand, as shown in FIG. 2 or 6, the IC socket 11 has a socket body 13 mounted to the printed circuit board, and a number of contact pins 15 are arranged to the socket body 13 so as to be contacted to or separated from the solder balls 12*a*, respectively A slide plate 17 as a movable member and a guide member 18 are disposed to the upper side of the socket body 13, and an adopter 20 and a location board 21 are also disposed to the lower side of the socket body 13.

In addition, an operation member 23 is disposed further above the slide plate 17 and the guide member 18 for moving the slide plate 17 in the horizontal direction by means of lever member 22, as a "driving mechanism".

Figure 23A:
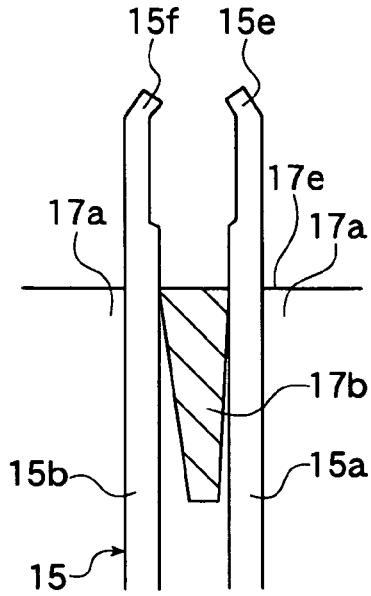
FIG. 23 includes FIG. 23A showing a contact pin of the closed state and FIG. 23B showing a contact pin of the opened state.
Figure 23B:
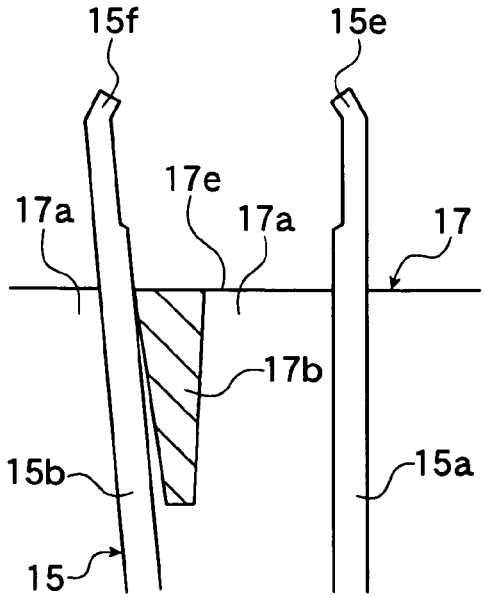

Each of the contact pins 15 is formed from a plate-like member having an elastic property, i.e., springy property and a good conductivity through a press-working. As shown in FIGS. 23A and 23B, the contact pin 15 has a pair of elastic portions constituting a stationary side elastic piece 15*a* and a movable side elastic piece 15*b* at portions above, in the vertical direction, the middle portion of the contact pin 15. The lower end portions of these elastic pieces 15*a* and 15*b* are formed as a single solder tail portion 15*c* as shown in FIG. 2, for example.

These elastic pieces 15*a* and 15*b* are arranged so as to oppose to each other and have front (tip) end portions formed as stationary contact portion 15*e* and movable contact portion 15*f*, respectively, which are contacted to or separated from the side portion of the solder ball 12*b* of the IC package 12, the solder ball 12*b* being then clamped between these contact portions 15*e* and 15*f*.

The contact pins 15 are pressed into press-in holes formed to the socket body 13, and the solder tail portions 15*c* projecting downward from the socket body 13 further extend downward through the location board 21 and then inserted into through holes formed to the printed circuit board and then soldered thereto.

Figure 11:
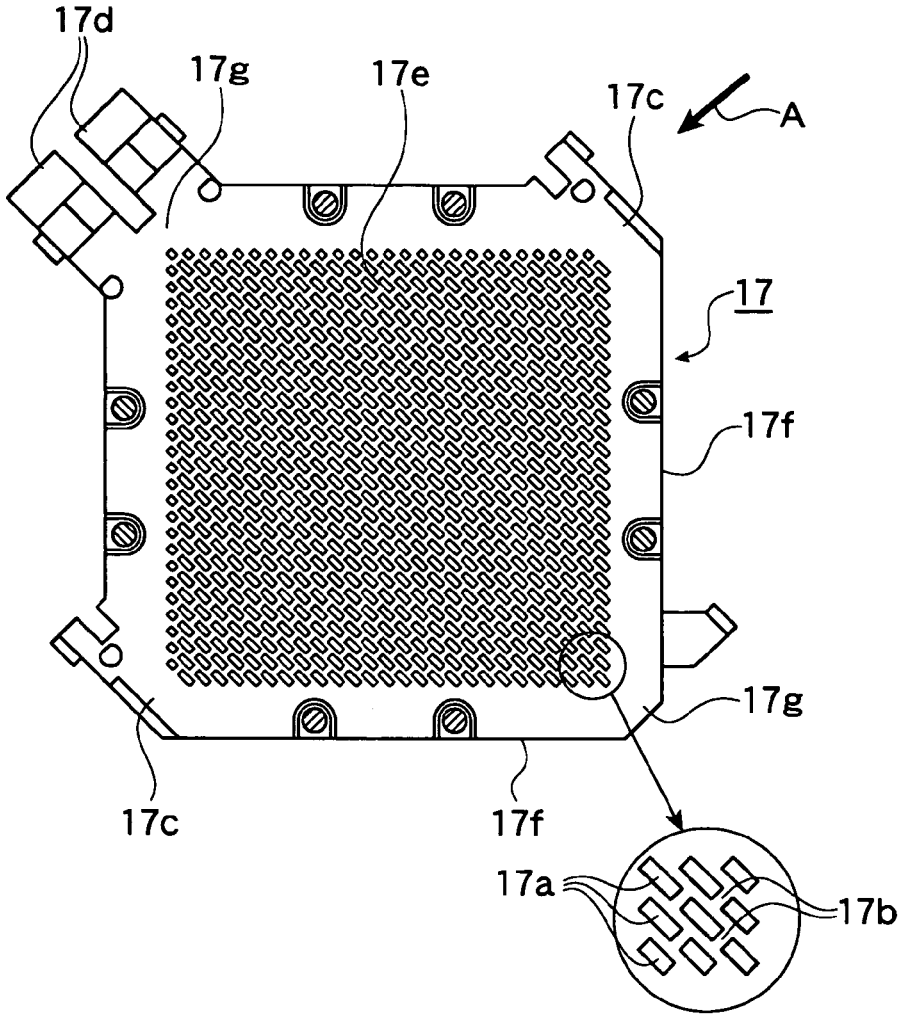
FIG. 11 is a plan view of the slide plate of the IC socket of the first embodiment.
Figure 12:
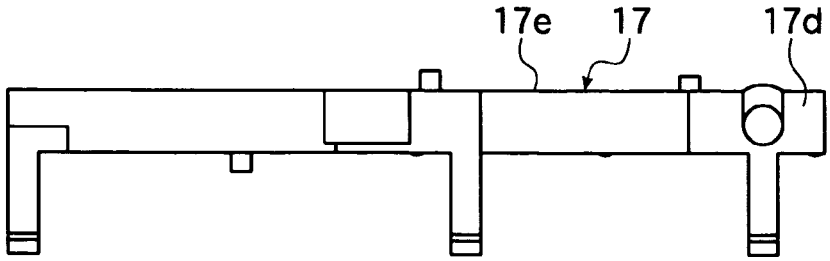
FIG. 12 is a side view of the slide plate viewed from a direction of an arrow A in FIG. 11.

The slide plate 17 has a rectangular plate shape as shown in FIG. 11 or 12 and is arranged to be movable in its diagonal direction with respect to the socket body 13. The slide plate 17 is formed with a number of insertion holes 17*a*, in a grid arrangement, into which the elastic pieces 15*a* and 15*b* of the contact pins 15 are inserted. A portion between these insertion holes 17*a* is formed as pressing portion 17*b* such as shown in FIG. 11.

In operation, when the slide plate 17 is moved, the movable elastic piece 15*b* is pressed and is elastically deformed by the pressing portion 17*b*, and the movable contact portion 15*f* is displaced in a predetermined amounts, as shown in FIGS. 23A and 23B.

Figure 7:
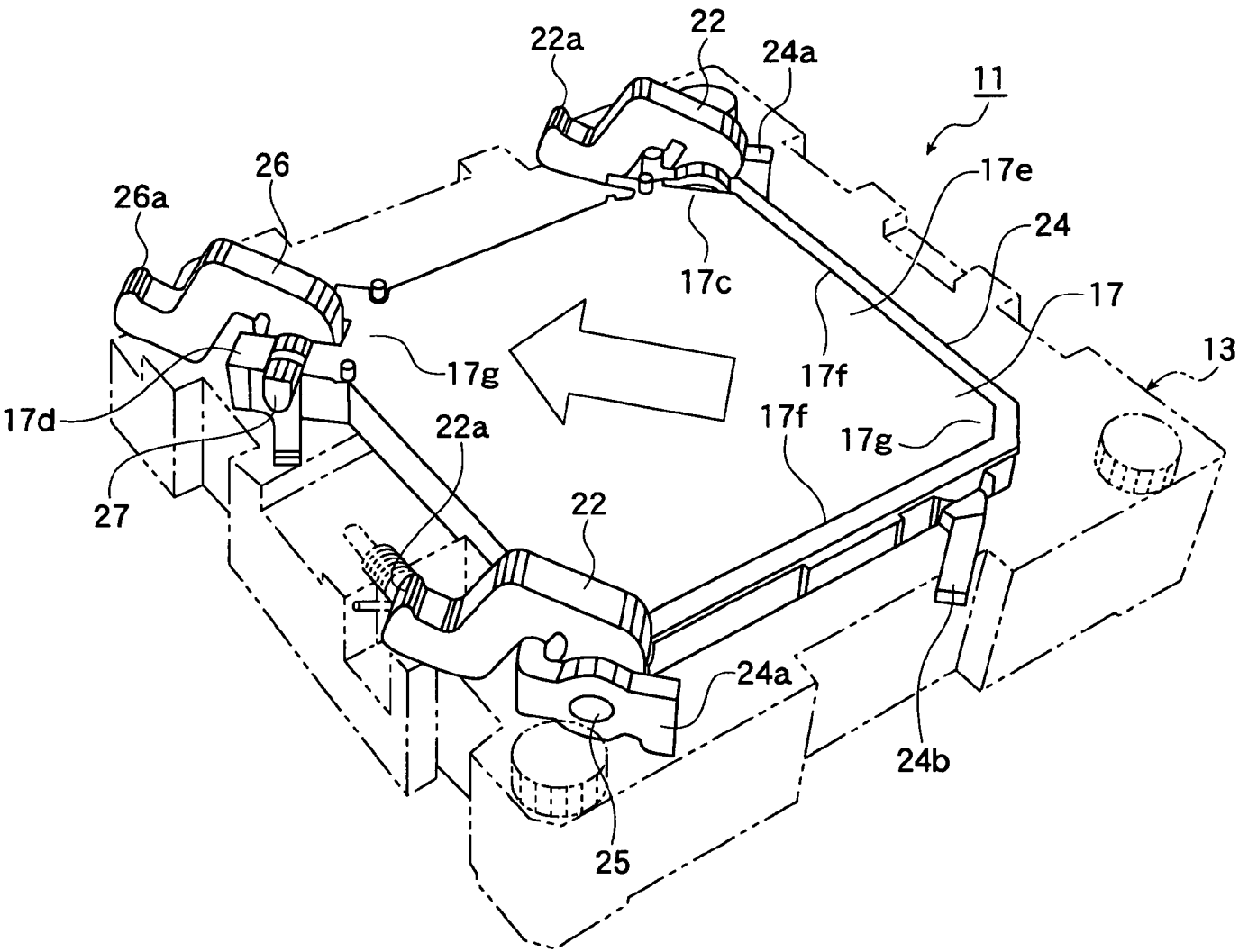
FIG. 7 shows a perspective view of a socket body of the IC socket of this first embodiment from which the operation member, a guide member and like are removed.

The slide plate 17 is provided with support plates 24 to the two sides 17*f*, 17*f* of a rear end side shown in FIG. 7, in the moving direction of the slide plate 17 for preventing a deformation of the slide plate 17 at the elastic deformation of the movable elastic piece 15*b* of the contact pin 15, and accordingly, the support plate 24 may be called "deformation prevention member".

Figure 13:
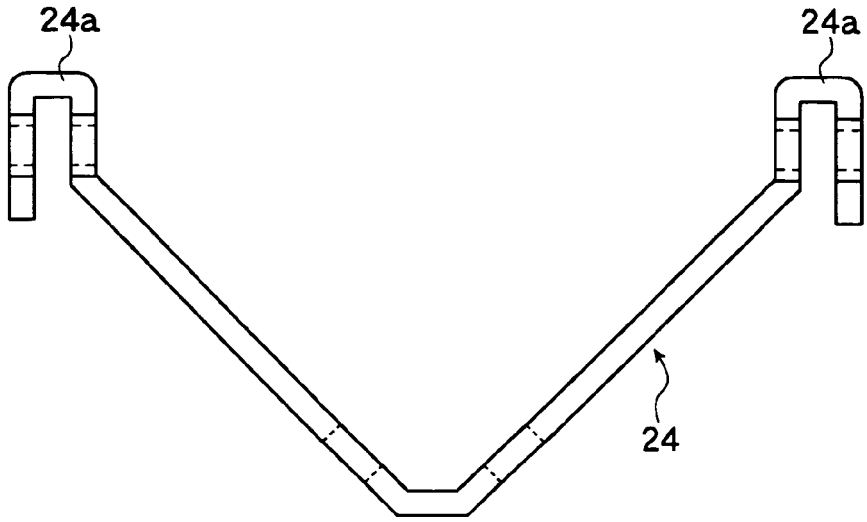
FIG. 13 is a plan view of the support plate of the IC socket of the first embodiment.
Figure 14:
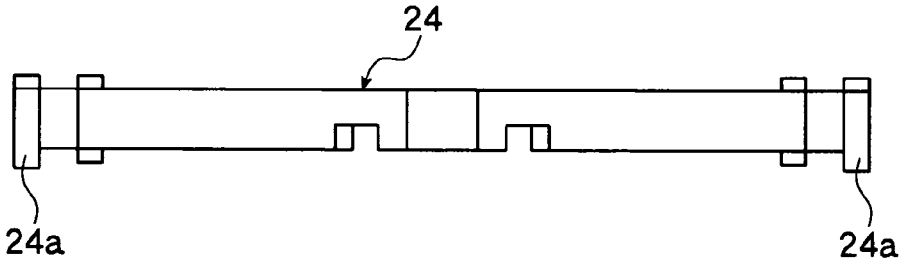
FIG. 14 is a front view of the support plate of FIG. 13.
Figure 15:
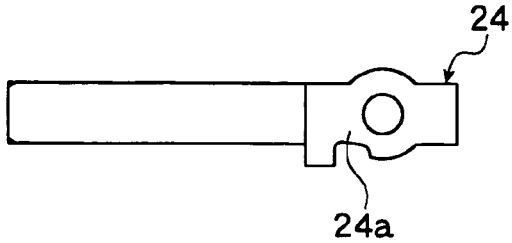
FIG. 15 is a right-side view of the support plate of FIG. 13.

Each of the support plates 24 is made of metal, and as shown in FIGS. 13 to 15, is bent so as to provide a right angle. Lever members 22, as portions or parts of the "driving mechanism", are provided for the end portions of the support plates 24. That is, both the end portions 24*a* of the support plate 24 are positioned at corner portions 17*c* of the slide plate 17 in one diagonal line direction normal to the moving direction of the slide plate 17. The end portions 24*a* are provided with a pair of support pieces 24*b* opposing to each other, between which the lever member 22 is arranged and clamped.

Figure 9:
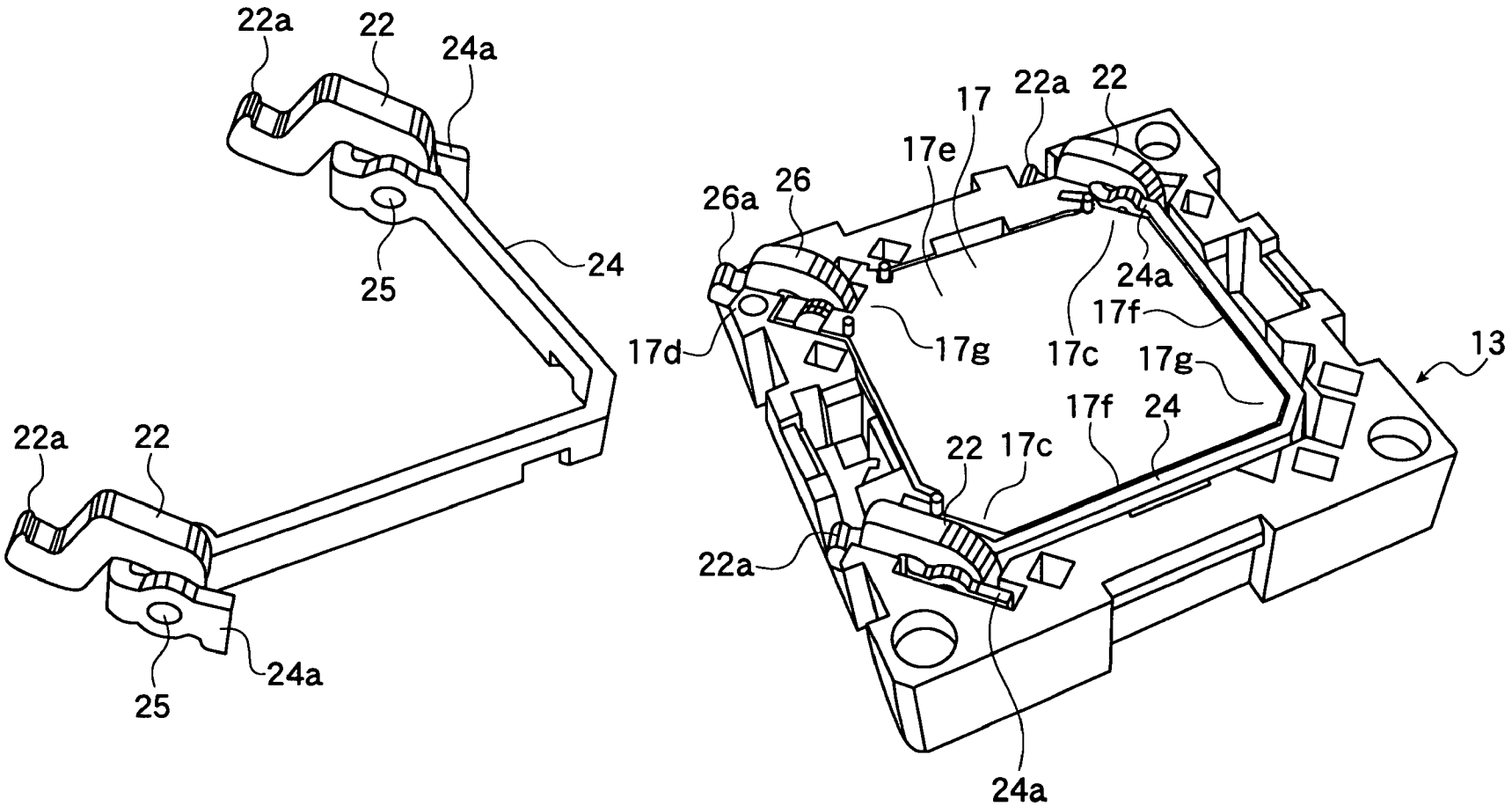
FIG. 9 is a perspective view of the socket body into which a support plate and associated parts are assembled.
Figure 10:
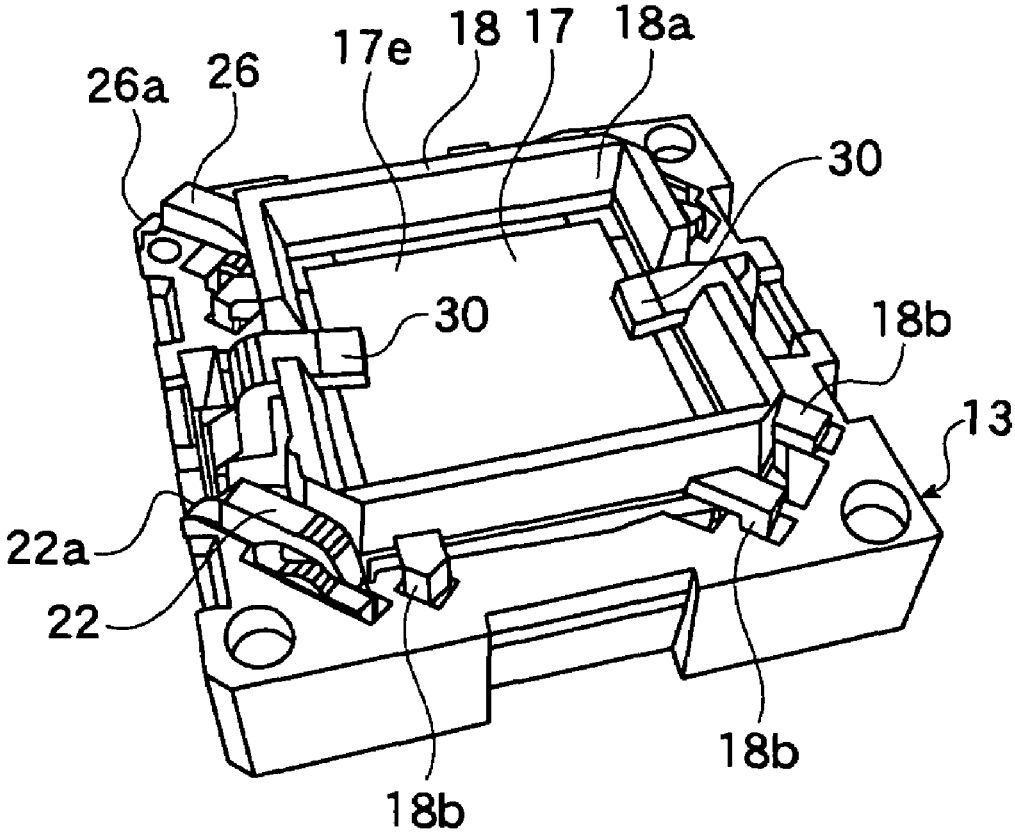
FIG. 10 is a perspective view of the socket body into which the guide member and a latch are assembled.
Figure 16:
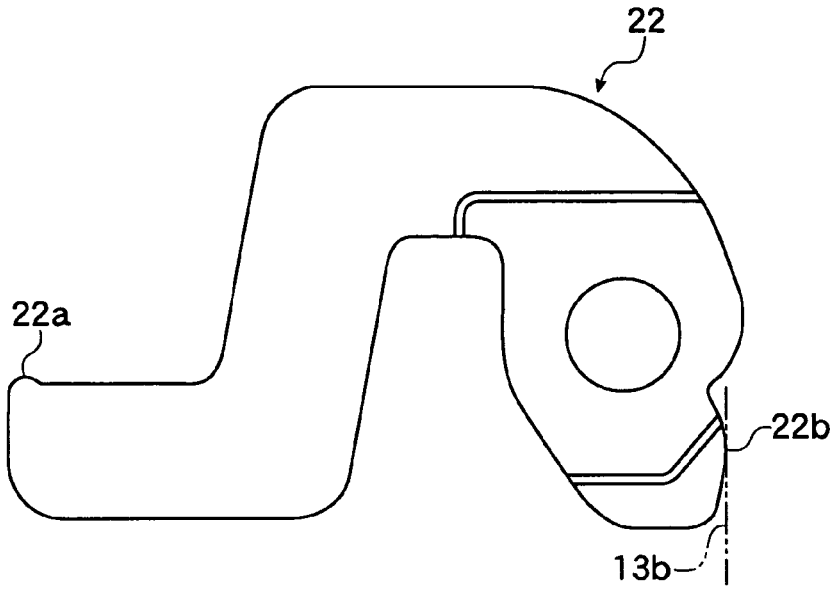
FIG. 16 is a front view of the support plate of the IC socket of the first embodiment.
Figure 17:
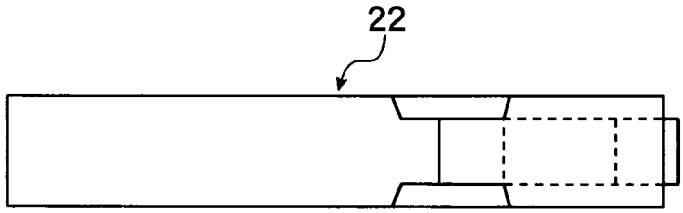
FIG. 17 is a bottom view of the IC socket of the first embodiment.
Figure 18:
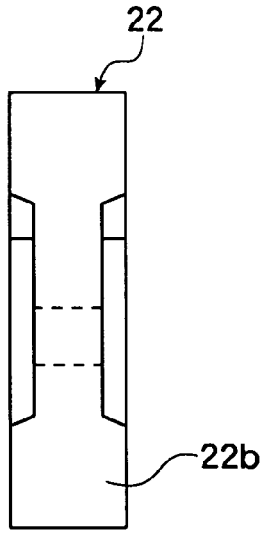
FIG. 18 is a right-side view of the IC socket of the first embodiment.
Figure 19:
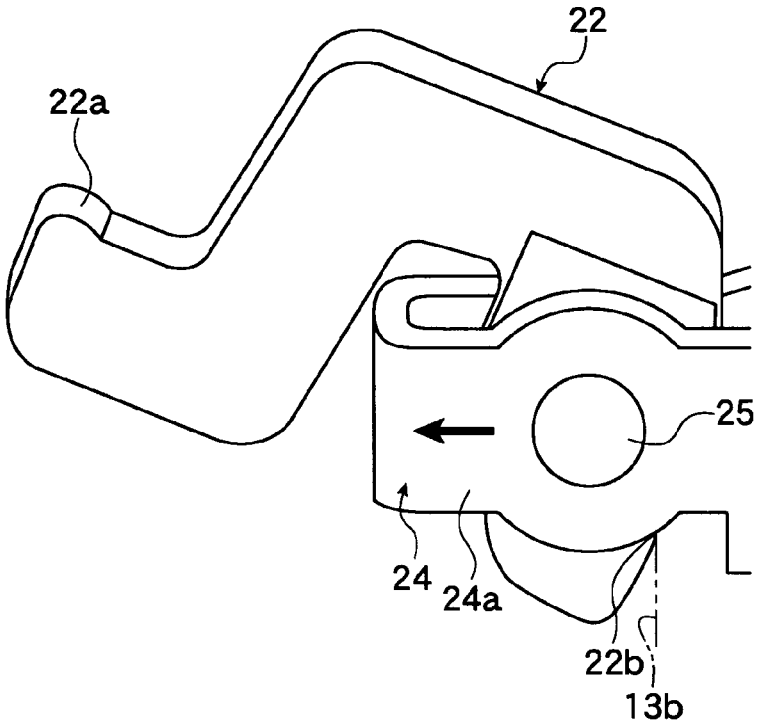
FIG. 19 is a perspective view, in an enlarged scale, showing a lever member of the IC socket of the first embodiment in a state before its pivotal rotation in the downward direction.

The lever member 22 has a shape shown in FIGS. 16 to 18 and is supported by a pair of supporting pieces 24*b* to be rotatable (pivotal) by means of the rotation (pivot) shaft 25 being the "force applied portion" as shown in FIGS. 9 and 19. This rotation shaft 25 is arranged to substantially the central portion of the side portion of the slide plate 17 in the moving direction thereof.

Furthermore, the lever member 22 is provided, at its front end portion (one end portion), with the force applied portion 22*a* which is pressed by the operation member 23, and at its rear end portion (other end portion), with the force support (fulcrum) portion 22*b* abutting against the pressing wall 13*b* of the socket body 13. The force support portion 22*b* is located at the position where the lever member 22 abuts against the pressing wall 13*b*, so that the force support portion 22*b* is slightly displaced in accordance with the pivotal rotation of the lever member 22.

When the force applied portion 22*a* of the lever member 22 is depressed downward to thereby rotate the rotation shaft 25 around its center, the pressing wall 13*b* of the socket body 13 is pressed by the force support portion 22*b*. Then, the rotation shaft 25 is moved by the reaction force from the pressing force, parallelly horizontally in the arrowed direction in FIGS. 19 to 22. Thus, the slide plate 17 is moved in the arrowed direction (diagonal direction) in FIG. 7 through the support plate 24.

Figure 22:
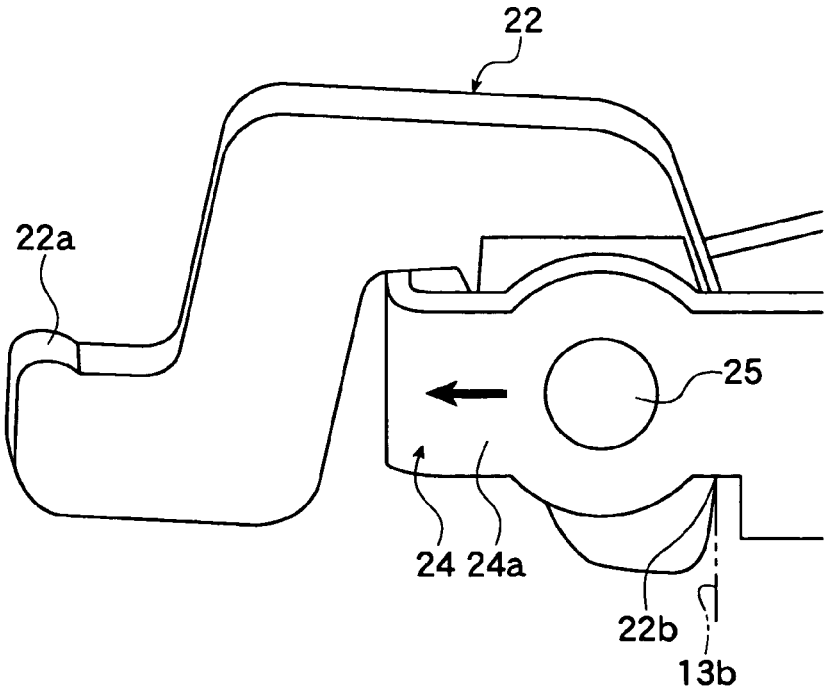
FIG. 22 is also a perspective view similar to that of FIG. 20 in a state that the lever member is further rotated to the most downward position from the state of FIG. 21.

Further, each of the lever members 22 is designed so that the force applied portion 22*a* takes a position approximately equal, in height level, to the rotation shaft 25 under a state that the lever member 22 is pressed downward to the fullest extent as shown in FIG. 22.

Figure 8:
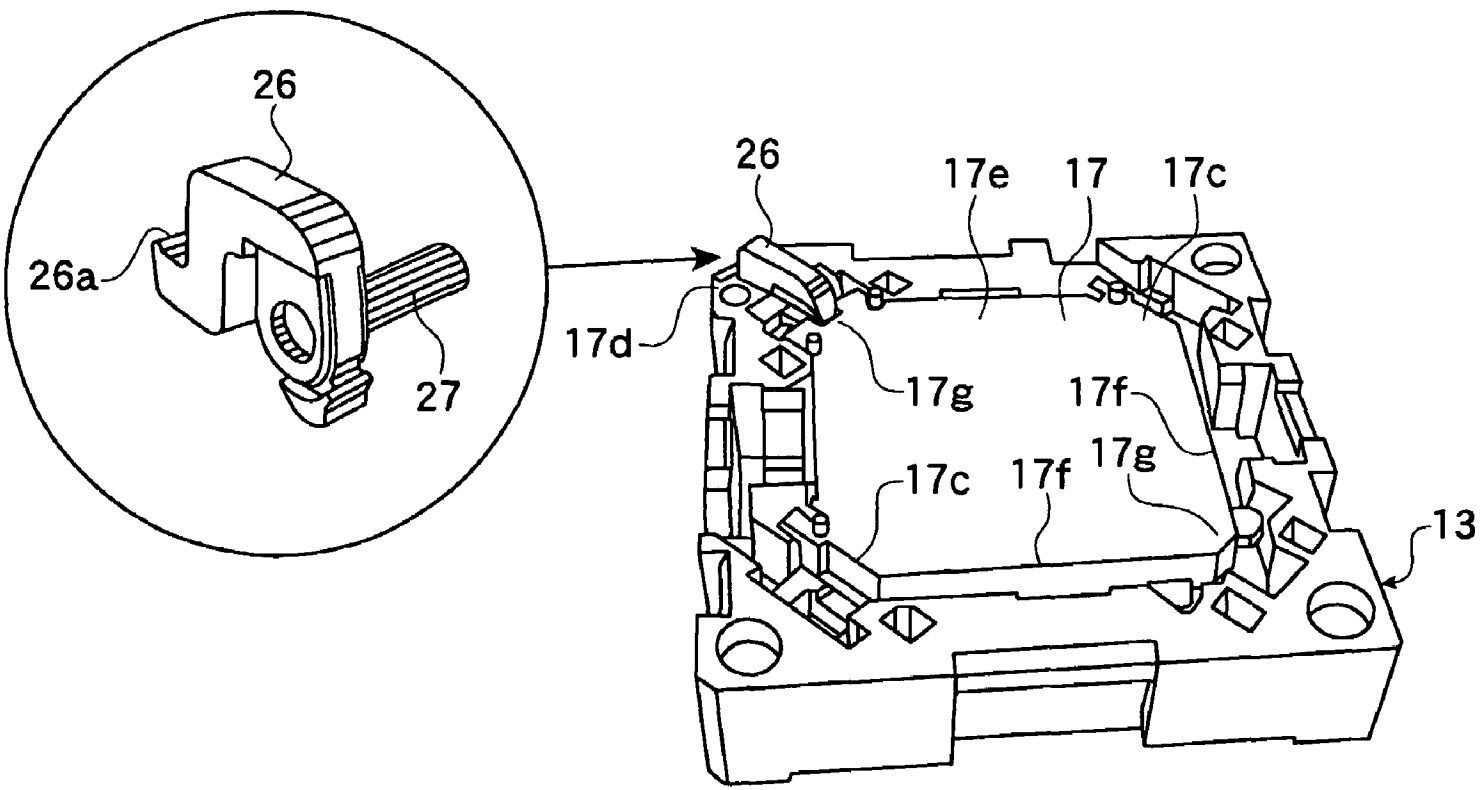
FIG. 8 is a perspective view of the socket body into which a slide plate, as movable member, is assembled.

Moreover, another lever member 26 is disposed, as shown in FIGS. 7 and 8, to the front end corner side in the moving direction of the slide plate 17 when the operation member 23 is lowered. This lever member 26 has a shape or structure similar to that of the lever member 22. That is, a pair of support pieces 17*d* are formed to the front end side of the slide plate 17 as shown in FIG. 11 and the lever member 26 is inserted between these support pieces 17*d* to be rotatable by a rotation (pivot) shaft 27. The lever member 26 is also provided with a force applied portion 26*a* pressed by the operation member 23 and a force support portion (fulcrum) 26*b* pressed toward the pressing wall 13*b* of the socket body 13.

When the force applied portion 26*a* of the lever member 26 is pressed downward and then rotated about the rotation shaft 27, the pressing wall 13*b* of the socket body 13 is pressed by the force support portion 26*b*, and then, by the reaction force, the rotation shaft 27 is moved in a parallel direction. Therefore, the front end portion in the moving direction of the slide plate 17 is pulled and moved in the arrowed direction (diagonal direction) in FIG. 7.

Figure 3:
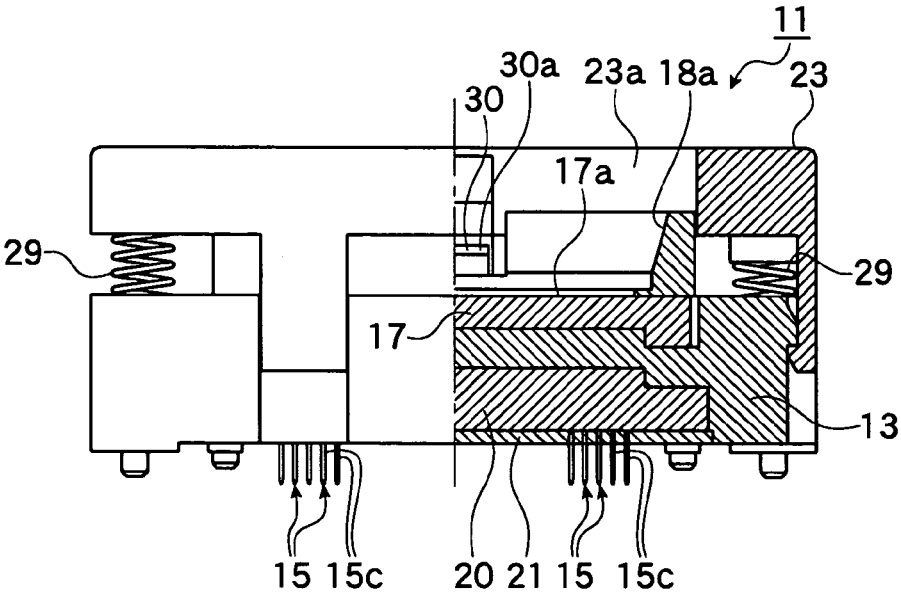
FIG. 3 is a sectional view taken along the line III—III in FIG. 1.
Figure 4:
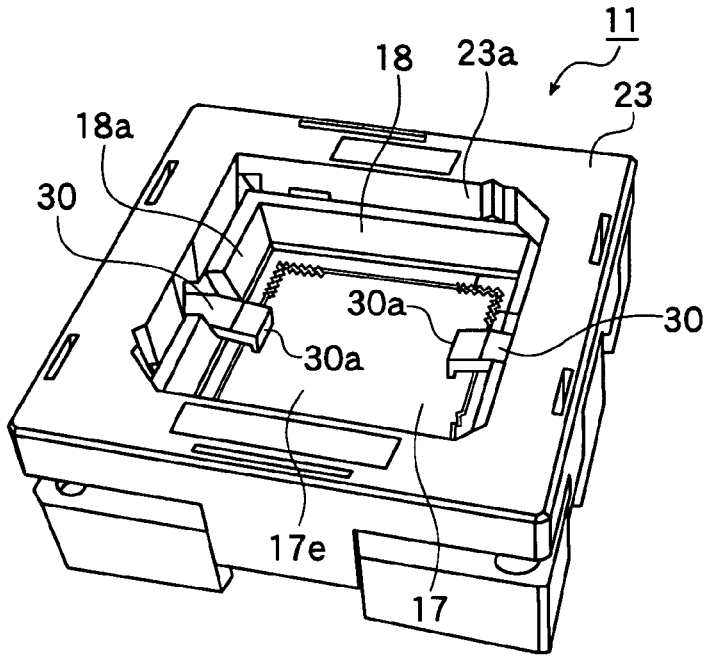
FIG. 4 is a perspective view of the IC socket of FIG. 1 in a state that an operation member of the socket is positioned at an uppermost position.
Figure 5:
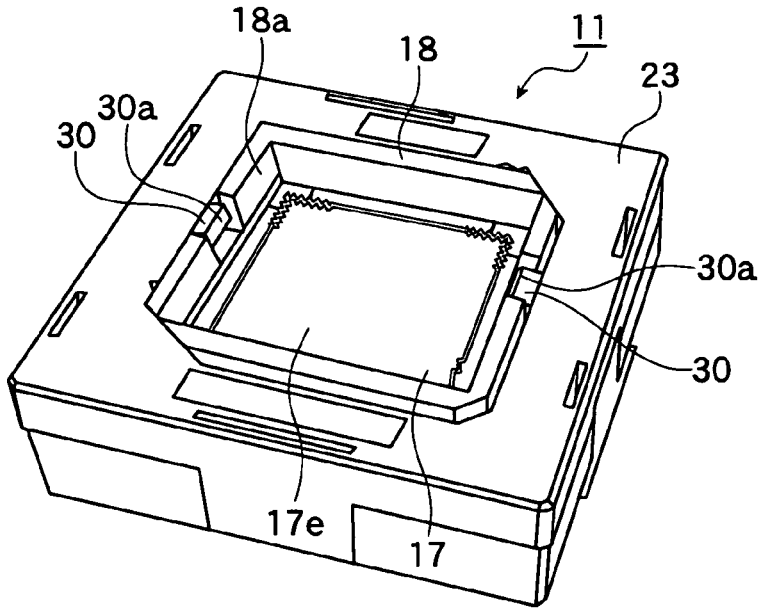
FIG. 5 is a perspective view of the IC socket of FIG. 1 in a state that an operation member of the socket is positioned at a lowermost position.

On the other hand, as shown in FIGS. 3 and 6, the guide member 18 has a rectangular frame shape and is formed with a guide surface 18*a* inclined for guiding the IC package 12 to the predetermined position and also provided with a plurality of engaging claws 18*b* for engaging or locking the IC package 12 to the socket body 13.

Furthermore, as shown in FIGS. 1 to 3, the operation member 23 has an opening 23*a* of a size allowing the IC package 12 to be inserted. After the IC package 12 is inserted through this opening 23*a*, it is mounted and accommodated to the predetermined position on the accommodation surface portion 17*e* of the slide plate 17.

Moreover, this operation member 23 is arranged to be vertically movable with respect to the socket body 13, as shown in FIG. 3, and is urged upward by means of spring 29. The operation member 23 is provided with a plurality of engaging claws 23*d*, which are disposed to project downward, and these engaging claws 23*d* are engaged with the socket body 13 at the uppermost position of the operation member 23 to stop the operation member 23 there. In addition, the operation member 23 is formed with a first operation projection, not shown, for pressing the force applied portions 22*a* and 26*a* of the lever members 22 and 26 and a second operation projection 23*c* for rotating a latch 30 as shown in FIG. 2.

The latch 30 is mounted to the socket body 13 to be pivotal around a shaft 31, as shown in FIG. 2, for example, and is urged towards the center direction of the socket body 13 by means of spring 32 so as to press the peripheral edge portion 12*c* of the IC package body 12*a* by a pressing portion 30*a* formed to the front end portion of the latch 30.

The latch 30 is also formed with a portion to be pressed (pressed portion 30*b*) which is pressed by the second operation projection 23*c* of the operation member 23. When the operation member 23 is lowered, the portion 30*b* is pressed by the second operation projection 23*c*, the latch 30 is then rotated in the outward direction of the socket body 13 as shown with two-dot-chain line in FIG. 2 and the pressing portion 30*a* of the latch 30 is retired from the IC package arranging position.

The socket for an electrical part, i.e., IC socket for the IC package according to the present invention of the structure mentioned above will operate as follows.

A printed circuit board on which a number of IC sockets 11 are arranged is previously prepared, and then, in order to set the IC packages 12 respectively to the IC sockets 11 by using an automatic machine, the operation member 23 is first pressed downward.

According to this lowering motion of the operation member 23, the force applied portions 22*a* and 26*a* of the lever members 22 and 26 are pressed by the first operation projection, not shown, of the operation member 23. Then, the lever members 22 and 26 are rotated, i.e., pivoted around the rotation shafts 25 and 27, and the force support portions 22*b* and 26*b* press the pressing wall 13*b* of the socket body 13 while sliding thereon. In this moment, by the reaction force from the pressing wall 13*b*, the respective rotation shafts 25 and 27 are moved horizontally in the arrowed direction in FIG. 7.

During the operation mentioned above, the lever members 22 operate in the following manner.

Figure 20:
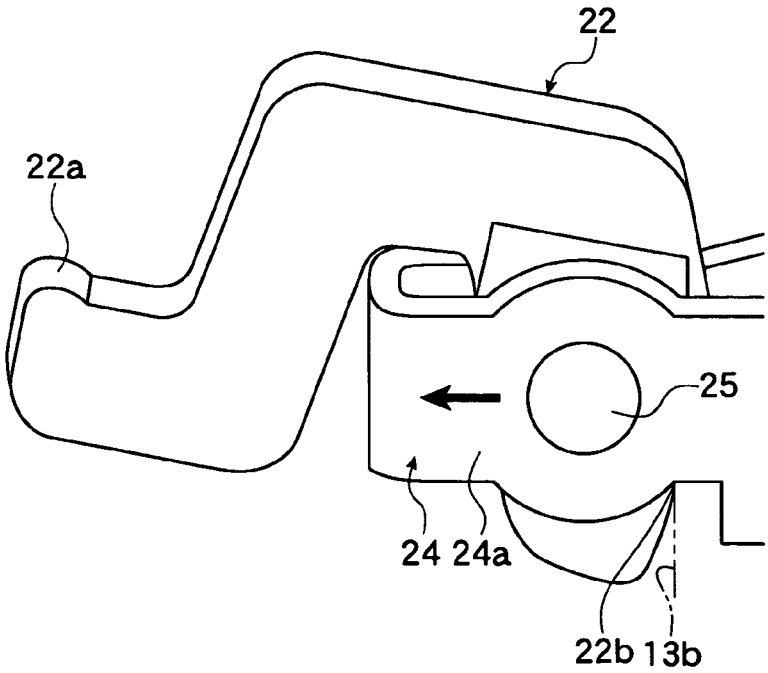
FIG. 20 is also a perspective view similar to that of FIG. 19 in a state that the lever member is rotated downward.
Figure 21:
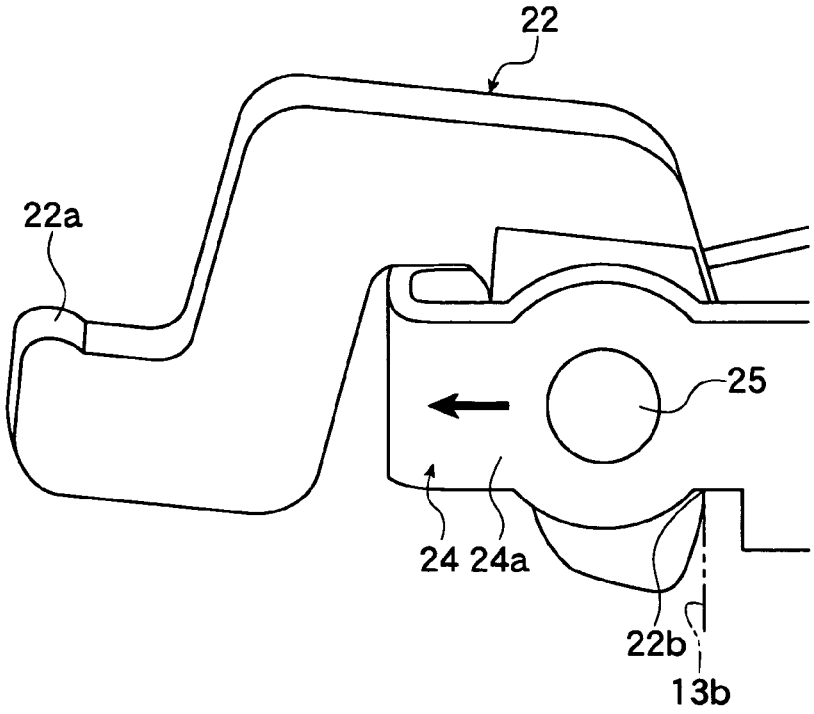
FIG. 21 is also a perspective view similar to that of FIG. 20 in a state that the lever member is further rotated downward from the state of FIG. 20.

When the force applied portion 22*a* of each lever member 22 is pressed from the state shown in FIG. 19, the lever member 22 is rotated around the rotation shaft 25, and the force support portion 22*b* presses the pressing wall 13*b* of the socket body 13 while sliding thereon as shown in FIGS. 20 and 21. In this moment, by the reaction force from the pressing wall 13*b*, each of the respective rotation shafts 25 is moved horizontally in the arrowed direction in FIG. 7, and the lever members 22 rotated to the utmost downward position as shown in FIG. 22.

Then, when the rotation shafts 25 and 27 are moved horizontally, the slide plate 17 is moved. When the rotation shaft 25 is moved horizontally, the slide plate 17 is moved via the support plate 24.

According to the movement of the slide plate 17 as mentioned above, the movable side elastic piece 15*b* of each of the contact pins 15 are pressed and elastically deformed by the pressing of the pressing portion 17*b* of the slide plate 17 from the state shown in FIG. 23A to the state shown in FIG. 23B. Thus, the paired contact portions 15*e* and 15*f* of the contact pin 15 are opened.

During the above operation, the pressed portion 30*b* of the latch 30 is pressed by the second operation projection 23*c* of the operation member 23, is rotated in the clockwise direction in FIG. 2 against the urging force of the spring 32, and the pressing portion 30*a* is then displaced to the retired position shown with two-dot-chain line in FIG. 2.

Under the state mentioned above, the IC package 12 conveyed by the automatic machine is accommodated onto the accommodation surface portion 17*e* of the slide plate 17 and then guided to the predetermined position by means of guide member 18*a*. At this position, the respective solder balls 12*b* of the IC package 12 are inserted into the insertion openings 17*a* of the slide plate 17 in the state of projecting downward over the slide plate 17 and inserted, in the non-contact state, into the paired contact portions 15*e* and 15*f* of the respective contact pins 15.

Thereafter, when the downward pressing force to the operation member 23 is released, the operation member 23 is moved upward by the urging force of the spring 29, and thereby, the pressing force applied to the lever members 22 and 26 are also released. Thus, the slide plate 17 is moved, in a direction reverse to the arrowed direction in FIG. 7, by the elastic force (elasticity) of the movable side elastic piece 15*b* of the contact pin 15.

At this time, the pressing force to the latch 30 applied by the operation member 23 is also released, the latch 30 is rotated in the counter-clockwise direction in FIG. 2 by the urging force of the spring 32, and the peripheral edge portion 12*c* of the IC package 12 is pressed by the pressing portion 30*a* of the latch 30.

When the slide plate 17 is moved in the direction reverse to the arrowed direction in FIG. 7, the movable side elastic piece 15*b* of each contact pin 15 returns to its original position, and the solder ball 12*b* is clamped between the contact portion 15*f* of the movable side elastic piece 15*b* and the contact portion 15*e* of the stationary side elastic piece 15*a* to thereby establish an electrical connection therebetween. In the state that the solder ball 12*b* is clamped between the contact portions 15*e* and 15*f*, the stationary side elastic piece 15*a* is also elastically deformed slightly in a direction along which the contact portion 15*e* of the stationary side elastic piece 15*a* is widened. According to the motion mentioned above, the solder balls 12*b* of the IC package 12 and the printed circuit board are electrically connected through the contact pins 15.

As mentioned hereinabove, The IC packages 12 are held by the IC sockets 11, respectively, and the printed circuit board mounted with these IC sockets 11, are set in a burn-in tank or vessel, and a temperature in the burn-in tank is increased to, for example, 125° C., to perform the burn-in test of the IC package 12.

In the next stage, when the IC packages 12 is dismounted from the accommodated state, the operation member 23 is first lowered. Then, as mentioned before, the slide plate 17 is moved in the arrowed direction in FIG. 7, the movable side elastic piece 15*b* is elastically deformed, and the contact portion 15*f* of the movable side elastic piece 15*b* is then deformed from the state shown in FIG. 23A to the state shown in FIG. 23B. According to this motion, the paired contact portions 15*e* and 15*f* are opened and separated from the solder ball 12*b* of the IC package 12, and under this state, the IC package 12 can be taken out from the IC socket 11 by the automatic machine with no pulling force.

According to the structure and function of the IC socket of the described first embodiment, since the position of the rotation shaft 25 (i.e., force applying portion) is positioned on the side of the square slide plate 17 and at substantially the central portion in the slide plate moving direction, an external force is applied to the slide plate 17 from this central portion. Therefore, any external force is not applied to the end portion of the slide plate, which may be applied in the conventional structure, the slide plate 17 can be moved with its attitude or position being stably maintained.

Furthermore, the paired lever members 22 are disposed at the portions near the corner portions 17*c* on the diagonal line perpendicular to the moving direction of the slide plate 17, so that a pair of lever members 22 having the same structure can be disposed on both sides of the slide plate 17. On the other hand, it is difficult to arrange a pair of lever members having the same structure on a pair of corner portions 17*g* on the other diagonal line along the moving direction of the slide plate 17. That is, in the described embodiment, the lever member 26 is disposed to one of the paired corner portions 17*g* on the other diagonal line along the moving direction of the slide plate 17 so as to be pulled in its moving direction, but, on the other one of the paired corner portions 17*g*, a structure for pushing the slide plate 17 is to be adopted, so that lever members 26 having the same structure are not disposed at the paired corner portions 17*g* on the other diagonal line.

Still furthermore, in an occasion when a number of movable side elastic pieces 15*b* are elastically deformed by moving the slide plate 17, a large force is applied to the slide plate 17. However, in the described embodiment, since metallic support plate 24 is disposed to the rear end side portion in the moving direction of the slide plate 17, the deformation of the slide plate 17 will be suppressed.

Moreover, the rotation shaft 25 (force applying portion) of the lever member 22 is coupled to the support plate 24 so as to transmit the driving force to the slide plate 17 through the support plate 24. Therefore, a force to be applied to the slide plate 17 is dispersed to thereby prevent the concentration of load, thus moving the slide plate 17 in a stable attitude.

In addition, the lever members 22 and 26 are arranged such that the force applied portions 22*a* and 26*a* and the force support portions 22*b* and 26*b* take substantially the same height levels in the state that the lever members are maximally pressed downward, i.e., that the slide plate 17 is maximally moved, as shown in FIG. 22. Accordingly, the pressing force to the operation member 23 in this state can be made relatively small, thus being advantageous.

That is, although, under this state, the reaction force from the movable side elastic piece 15*b* is made maximally large, since the force applied portions 22*a* and 26*a* and the force support portions 22*b* and 26*b* take substantially the same height levels, a force F for depressing the operation member 23 acts as it is, with substantially no loss, as a force to rotate the lever members 22 and 26, and such force acts as a force to move the slide plate 17 via the rotation shafts 25 and 27 (force applying portions), thus making relatively small the force to press the operation member 23.

In the above embodiment, the lever member 26 is optional one and it may be eliminated from location.

[Second Embodiment]

The second embodiment of the present invention will be described hereunder with reference to FIGS. 25 to 28.

This second embodiment differs, from the first embodiment, in the "driving mechanism" for the slide plate 17.

That is, this "driving mechanism" comprises two first links 35 in form of thin plate and a second link 36 disposed between these two first links 35. One end portion 35*a* of each first link 35 is coupled to the end portion 24*a* of the support plate 24 to be pivotal around a shaft 37 (force applying portion) and the other end portion 35*b* of the first link 35 is coupled to the second link 36 by means of shaft 38 to be pivotal. The second link 36 has a base end portion 36*a* which is coupled to the socket body 13 to be pivotal by means of shaft 39 (force support portion) and has front end portion 36*b* (force applied portion) to be pressed by the operation member 23.

Figure 26:
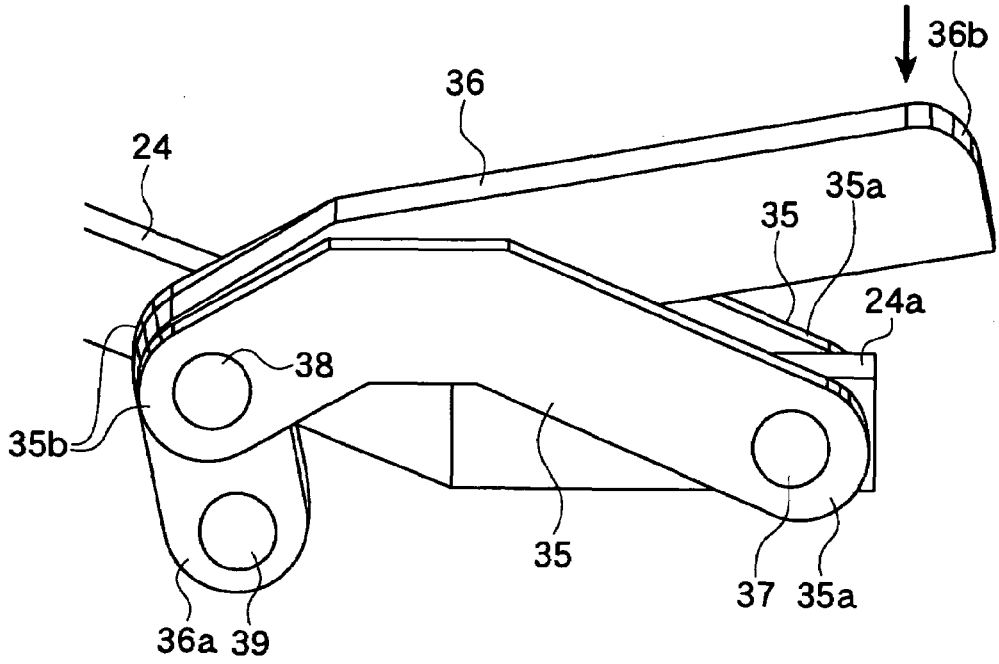
FIG. 26 is a perspective view showing the IC socket of the second embodiment showing a state of the first and second links before the downward rotation thereof.
Figure 27:
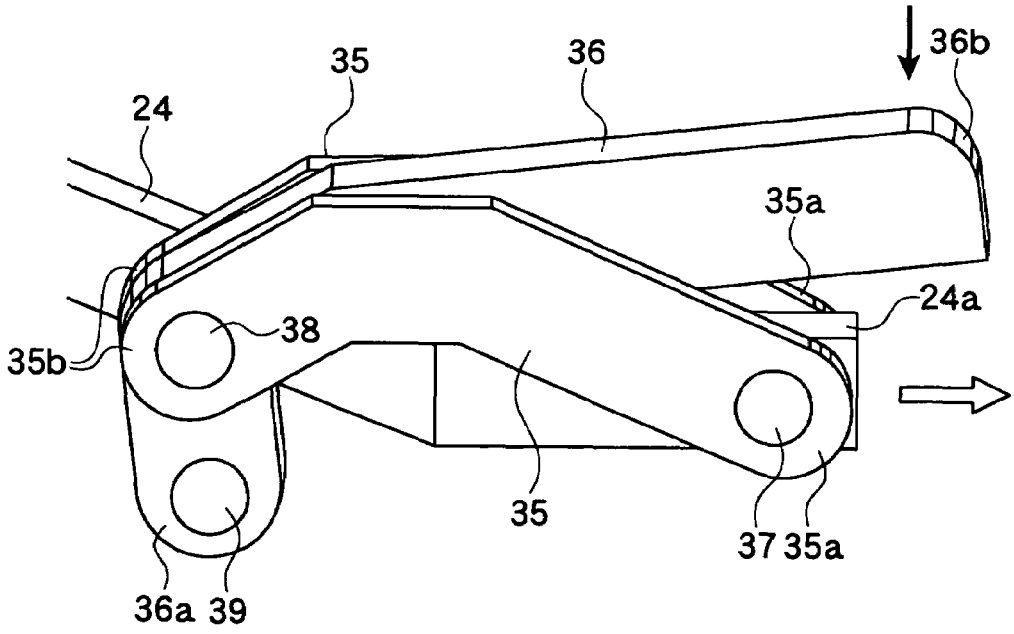
FIG. 27 is a perspective view showing the IC socket of the second embodiment showing a state that the first and second links are pivotally rotated downward from the state shown in FIG. 26.
Figure 28:
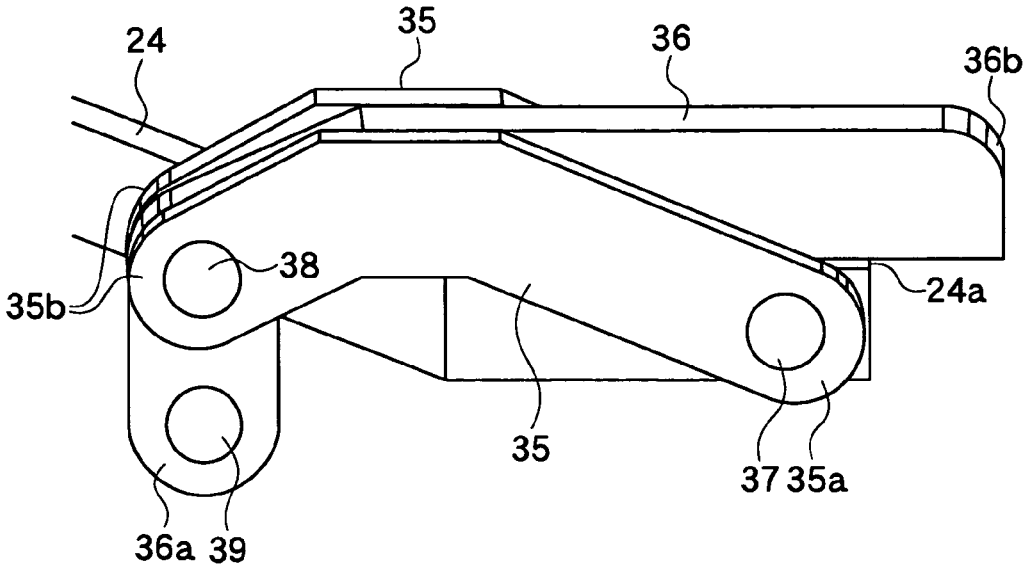
FIG. 28 is also a perspective view showing the IC socket of the second embodiment showing the lowermost state of the first and second links.

In the structure of the second embodiment, when the operation member 23 is lowered and the front end portion 36*b* of the second link 36 is depressed downward, the second link 36 is rotated downward about the shaft 39 from the state shown in FIG. 26 to the states shown in FIG. 27 and then in FIG. 28. FIG. 28 shows a state in which the second link 36 is rotated downward maximally.

According to this operation, the support plate 24 is pressed in the arrowed direction in FIG. 27 through the shaft 37 (force applying portion) of the first link 35 to thereby move the slide plate 17 in the arrowed direction.

The other structures and operation or functions of this second embodiment are substantially the same as those of the first embodiment, so that the detailed explanation thereof is omitted herein.

It is further to be noted that the present invention is not limited to the described embodiments and many other changes and modifications may be made without departing from the scopes of the appended claims.

For example, in the described embodiments, although the present invention is applied to the IC socket referred to as "socket for an electrical part", the present invention may be otherwise applicable to other like devices.

In the described embodiment, although the contact pin 15 includes a pair of elastic pieces 15*a* and 15*b* both having elastic property, contact pin can have only one elastic piece.

Figure 29:
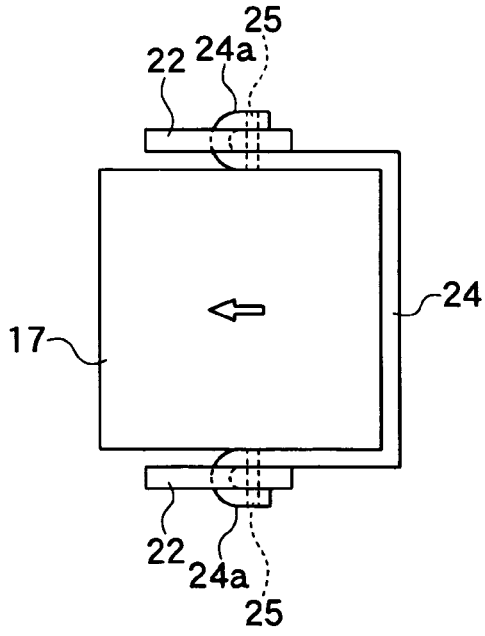
FIG. 29 is an illustrated plan view of a modified example of the IC socket of the first embodiment of the present invention.

In addition, a structure, in which the slide plate 17 is moved in a direction parallel to the side of the square shape thereof as shown in FIG. 29 in place of the diagonal direction, may be adopted. That is, in such modification, a box-shaped support plate 24 is provided for the slide plate 17 and the lever members 22 are mounted to both end portions 24*a* of the support plate 24 through the pivotal shaft 25 (force applying portion). The pivotal shaft 25 is positioned at substantially the central portion of the side portion of the slide plate 17 in its moving direction.

Furthermore, the driving mechanism for the slide plate is not limited to the described ones and another mechanism may be adopted as far as it can convert the vertical force to the horizontal force to move the movable member in the horizontal direction.

Furthermore, although in the described embodiment, the lever member 26 is provided, it is not indispensable.

What is claimed is:

1. A socket for an electrical part comprising:

a socket body to which an electrical part is mounted and accommodated;

a number of contact pins provided for the socket body so as to be contacted to or separated from terminals of the electrical part, each of said contact pins being provided with a pair of contact portions;

a movable member provided for the socket body to be horizontally movable so as to deform the contact portions of the contact pin; and a driving mechanism provided for the socket body to move the movable member, wherein said driving mechanism has a force applying portion through which a force is applied to the movable member to move the movable member and said force applying portion is disposed at substantially a central portion on a side portion of the movable member in the movable member moving direction and on a line normal to a moving direction of the movable member, the line passing through substantially a central portion of the length of said movable member in the moving direction of said moving member.

2. A socket for an electrical part according to claim 1, wherein the driving mechanism is a pair of driving mechanisms, a pair of force applying portions are disposed on side portions of the movable member, said side portions are opposed to each other with respect to a center line disposed parallel to said moving direction of the movable member.

3. The socket for an electrical part according to claim 1, wherein said movable member is provided, at a rear end side in a moving direction thereof, with a deformation prevention member for preventing the movable member from being deformed at a time of elastically deforming the contact pin.

4. The socket for an electrical part according to claim 3, wherein said force applying portion of the driving mechanism is coupled to the deformation prevention member.

5. The socket for an electrical part according to claim 1, wherein said driving mechanism is provided with lever members, each of said lever members being pivotal in a vertical direction with respect to the movable member and being formed with a force applied portion to which an external force is applied, a force support portion coupled to the socket body and the force applying portion coupled to the movable member, and when the force applied portion of the lever member is pressed, the lever member is rotated about the force support portion and the movable member is thereby moved by the force applying portion.

6. The socket for an electrical part according to claim 5, wherein said driving mechanism includes a further lever member provided for the movable member at a corner portion thereof along the one diagonal line in the movable member moving direction, said further lever member being provided with a force applied portion and a support portion operatively connected to the movable member.

7. The socket for an electrical part according to claim 1, wherein said movable member comprises a plate member having substantially a square shape and is moved in one diagonal direction thereof with respect to the socket body, and the force applying portion of the driving mechanism is disposed to a portion near a corner portion of the movable member along another diagonal line normal to the moving direction of the movable member.

8. The socket for an electrical part according to claim 7, wherein said movable member is provided, at a rear end side in a moving direction thereof, with a deformation prevention member for preventing the movable member from being deformed at a time of elastically deforming the contact pin.

9. The socket for an electrical part according to claim 7, wherein said driving mechanism is provided with lever members, each of said lever members being pivotal in a vertical direction with respect to the movable member and being formed with a force applied portion to which an external force is applied, a force support portion coupled to the socket body and the force applying portion coupled to the movable member, and when the force applied portion of the lever member is pressed, the lever member is rotated about the force support portion and the movable member is thereby moved by the force applying portion.

10. The socket for an electrical part according to claim 9, wherein said driving mechanism includes a further lever member provided for the movable member at a corner portion thereof along the one diagonal line in the movable member moving direction, said further lever member being provided with a force applied portion and a support portion operatively connected to the movable member.

11. A socket for an electrical part comprising:

a socket body to which an electrical part is mounted and accommodated;

a number of contact pins provided for the socket body so as to be contacted to or separated from terminals of the electrical part, each of said contact pins being provided with a pair of contact portions;

a slide plate provided for the socket body to be movable to thereby deform the contact portions of the contact pin, said slide plate having substantially square plate shape;

a driving mechanism provided for the socket body to move the slide plate, said driving mechanism including an operation member mounted to the socket body to be vertically movable; and a deformation prevention member for preventing deformation of the slide plate at a time when the contact pin is elastically deformed, wherein said driving mechanism includes a pair of lever members disposed to portions near corner portions of the slide plate along a diagonal line normal to the moving direction of the slide plate and connected to the operation member by which a pressing force is applied when the operation member is pressed downward, and said deformation prevention member has both ends to each of which a pair of support pieces are formed between which each of the lever members are clamped and supported.

12. A socket for an electrical part comprising:

a socket body to which an electrical part is mounted and accommodated;

a number of contact pins provided for the socket body so as to be contacted to or separated from terminals of the electrical part, each of said contact pins being provided with a pair of contact portions;

a movable member provided for the socket body to be horizontally movable so as to deform the contact portions of the contact pin;

a driving mechanism provided for the socket body to move the movable member, said driving mechanism has a force applying portion through which a force is applied to the movable member to move the movable member and said force applying portion is disposed at substantially a central portion on a side portion of the movable member in the movable member moving direction; and wherein said movable member comprises a plate member having substantially a square shape and is moved in one diagonal direction thereof with respect to the socket body, and the force applying portion of the driving mechanism is disposed to a portion near a corner portion of the movable member along another diagonal line normal to the moving direction of the movable member.

13. The socket for an electrical part according to claim 12, wherein said movable member is provided, at a rear end side in a moving direction thereof, with a deformation prevention member for preventing the movable member from being deformed at a time of elastically deforming the contact pin.

14. The socket for an electrical part according to claim 12, wherein said driving mechanism is provided with lever members, each of said lever members being pivotal in a vertical direction with respect to the movable member and being formed with a force applied portion to which an external force is applied, a force support portion coupled to the socket body and the force applying portion coupled to the movable member, and when the force applied portion of the lever member is pressed, the lever member is rotated about the force support portion and the movable member is thereby moved by the force applying portion.

15. The socket for an electrical part according to claim 14, wherein said driving mechanism includes a further lever member provided for the movable member at a corner portion thereof along the one diagonal line in the movable member moving direction, said further lever member being provided with a force applied portion and a support portion operatively connected to the movable member.

16. A socket for an electrical part comprising:

a socket body to which an electrical part is mounted and accommodated;

a number of contact pins provided for the socket body so as to be contacted to or separated from terminals of the electrical part, each of said contact pins being provided with a pair of contact portions;

a movable member provided for the socket body to be horizontally movable so as to deform the contact portions of the contact pin;

a driving mechanism provided for the socket body to move the movable member;

said driving mechanism has a force applying portion through which a force is applied to the movable member to move the movable member and said force applying portion is disposed at substantially a central portion on a side portion of the movable member in the movable member moving direction;

said movable member is provided, at a rear end side in a moving direction thereof, with a deformation prevention member for preventing the movable member from being deformed at a time of elastically deforming the contact pin; and wherein said force applying portion of the driving mechanism is coupled to the deformation prevention member.

17. A socket for an electrical part comprising:

a socket body to which an electrical part is mounted and accommodated;

a number of contact pins provided for the socket body so as to be contacted to or separated from terminals of the electrical part, each of said contact pins being provided with a pair of contact portions;

a movable member provided for the socket body to be horizontally movable so as to deform the contact portions of the contact pin; and a driving mechanism provided for the socket body to move the movable member;

said driving mechanism has a force applying portion through which a force is applied to the movable member to move the movable member and said force applying portion is disposed at substantially a central portion on a side portion of the movable member in the movable member moving direction; and wherein said driving mechanism is provided with lever members, each of said lever members being pivotal in a vertical direction with respect to the movable member and being formed with a force applied portion to which an external force is applied, a force support portion coupled to the socket body and the force applying portion coupled to the movable member, and when the force applied portion of the lever member is pressed, the lever member is rotated about the force support portion and the movable member is thereby moved by the force applying portion.

18. A socket for an electrical part according to claim 17, wherein said driving mechanism includes a further lever member provided for the movable member at a corner portion thereof along the one diagonal line in the movable member moving direction, said further lever member being provided with a force applied portion and a support portion operatively connected to the movable member.

* * * * *